US010100484B2

(12) United States Patent
Shi et al.

(10) Patent No.: US 10,100,484 B2
(45) Date of Patent: Oct. 16, 2018

(54) TOWER SUPPORT STRUCTURE

(71) Applicant: Ambor Structures, Inc., St. Paul, MN (US)

(72) Inventors: Honglang Shi, Shanghai (CN); Xibo Sun, Shanghai (CN); Wei Jiang, Shanghai (CN)

(73) Assignee: Ambor Structures, Inc., St. Paul, MN (US)

( * ) Notice: Subject to any disclaimer, the term of this patent is extended or adjusted under 35 U.S.C. 154(b) by 0 days.

(21) Appl. No.: 15/696,695

(22) Filed: Sep. 6, 2017

(65) Prior Publication Data

US 2017/0362791 A1 Dec. 21, 2017

Related U.S. Application Data

(63) Continuation of application No. 15/346,211, filed on Nov. 8, 2016, now Pat. No. 9,803,331, which is a continuation of application No. 14/618,648, filed on Feb. 10, 2015, now Pat. No. 9,499,954.

(51) Int. Cl.

| | |
|---|---|
| ***E04H 12/18*** | (2006.01) |
| ***E02D 27/42*** | (2006.01) |
| ***E04H 12/22*** | (2006.01) |
| ***E02D 27/02*** | (2006.01) |
| ***E02D 27/08*** | (2006.01) |
| ***E02D 27/26*** | (2006.01) |

(52) U.S. Cl.

CPC ..... *E02D 27/42* (2013.01); *E02D 27/02* (2013.01); *E02D 27/08* (2013.01); *E02D 27/26* (2013.01); *E04H 12/2238* (2013.01)

(58) Field of Classification Search

CPC . E04H 12/2246; E04H 12/2238; E04H 12/22; E04H 12/00; E02D 27/42; E02D 27/02

See application file for complete search history.

(56) References Cited

U.S. PATENT DOCUMENTS

| | | | |
|---|---|---|---|
| 2,309,041 | A | 7/1940 | Booker et al. |
| 3,328,921 | A | 7/1967 | Keslin |
| 4,930,753 | A | 6/1990 | Alvyn |
| 5,499,885 | A | 3/1996 | Chapman |

(Continued)

FOREIGN PATENT DOCUMENTS

| | | |
|---|---|---|
| CN | 202004981 | 10/2011 |
| CN | 202500359 | 10/2012 |

(Continued)

OTHER PUBLICATIONS

Letter from Westman Champlin & Koehler Regarding Alleged Infringement of ARE Telecom Incorporated's Intellecutal Property, dated Apr. 28, 2015, 2 pages.

(Continued)

*Primary Examiner* — Christine T Cajilig

(74) *Attorney, Agent, or Firm* — Patterson Thuente Pedersen, P.A.

(57) ABSTRACT

A foundation for a tower, the foundation including a main pedestal support structured to engage to a base of the tower. A floor structure surrounds and is secured to the main pedestal support. A wall structure surrounds the floor structure proximate a perimeter thereof, secured to the perimeter of the floor structure and extending upwardly from the floor structure. The main pedestal support is located generally centrally in the floor structure.

18 Claims, 11 Drawing Sheets

(56) References Cited

U.S. PATENT DOCUMENTS

| | | | |
|---|---|---|---|
| 5,531,419 | A | 7/1996 | Gustafsson et al. |
| 6,925,957 | B2 | 8/2005 | Schultz |
| 6,982,680 | B2 | 1/2006 | Janoschka et al. |
| 7,017,509 | B2 | 3/2006 | Schultz |
| 8,240,051 | B2 | 8/2012 | Fedock et al. |
| 8,245,258 | B2 | 8/2012 | Park et al. |
| 8,439,166 | B2 | 5/2013 | Kreller |
| 8,516,774 | B2 | 8/2013 | Zavitz et al. |
| 8,919,051 | B1 | 12/2014 | Echemendia et al. |
| 9,328,861 | B2 | 5/2016 | Johnson et al. |
| 9,428,877 | B2 | 8/2016 | Clifton |
| 2004/0233120 | A1 | 11/2004 | Ryan |
| 2011/0061321 | A1 | 3/2011 | Phuly |
| 2012/0228442 | A1 | 9/2012 | Clifton |
| 2013/0146739 | A1 | 6/2013 | Zhao |
| 2015/0197957 | A1 | 7/2015 | Anderson |
| 2015/0308140 | A1 | 10/2015 | Clifton |
| 2015/0376857 | A1 | 12/2015 | Clifton |

FOREIGN PATENT DOCUMENTS

| | | | |
|---|---|---|---|
| FR | 2856716 | A1 | 12/2004 |
| NL | 1003089 | C2 | 11/1997 |
| WO | WO 2014/182870 | A1 | 11/2014 |
| WO | WO 2015/061862 | A1 | 5/2015 |

OTHER PUBLICATIONS

Application and File History for U.S. Appl. No. 14/618,648, filed Feb. 10, 2015. Inventors: Honglang Shi et al.

Application and File History for U.S. Appl. No. 15/346,211, filed Nov. 8, 2016. Inventors: Honglang Shi et al.

TOWER SUPPORT STRUCTURE

CROSS-REFERENCE TO RELATED APPLICATION

This application is a continuation of application Ser. No. 15/346,211, filed Nov. 8, 2016, now U.S. Pat. No. 9,803,331, issued Oct. 31, 2017, entitled "Tower Support Structure", which is a continuation of application Ser. No. 14/618,648, filed Feb. 10, 2015, now U.S. Pat. No. 9,499,954, issued Nov. 22, 2016, entitled "Tower Support Structure", each of which is hereby fully incorporated herein by reference.

FIELD OF THE INVENTION

The invention generally relates to towers such as communication towers, wind power towers and lighting towers. More particularly, the invention relates to a foundation or support structure for a tower.

BACKGROUND

Towers or other vertical supports are utilized to support many structures such as cell phone antennas, other broadcast antennas, lights, wind power turbines and many other appliances. Towers of any significant height and bearing any significant load must be attached to some form of foundation to keep the tower upright and to resist the forces of wind and weather.

In construction engineering, foundations and foundation designs can vary but commonly use poured concrete and reinforcing rods or reinforcing bars to form a heavy integral structure that is either buried or placed on the ground to support a structure such as a tower. However, the use of concrete foundations is not always convenient or even feasible.

In many of these cases, the use of a concrete foundation is not practical because of limited availability of concrete, long concrete casting and curing times, or the fact that concrete construction creates a large amount of construction waste. For example, materials used for concrete forms often cannot be reused and must be discarded.

Accordingly, there is still room for improvement in the arts related to tower installation and tower foundations.

SUMMARY

The present invention solves many of the above discussed problems by providing a structure that can be fully assembled and disassembled in a short period of time and that permits the utilization of local materials to provide ballast. The foundation structure of the present invention eliminates many of the issues typical to a standard foundation utilized for support structures such as communications towers.

Recent trends have demonstrated a need for temporary, quick to assemble and disassemble foundation on which to mount a tower. A need has also been recognized for a foundation having reduced environmental impact.

For example, after major natural disasters, such as earthquakes, typhoons, tornadoes and tsunamis, there is often a need to rapidly construct temporary structures for lighting, telecommunications and/or security applications. Often, it is necessary to locate these towers or structures in remote locations. Remote locations often have limited accessibility and complex or unfavorable terrain that may make it difficult to transport concrete to a foundation site. Further, the distance from a ready mix concrete plant may make it prohibitively expensive or prohibitively difficult to transport concrete to the construction site.

Even without considering natural disasters or other emergency needs to provide foundations for tower-like structures, growing telecommunications demand has created a need to construct or deploy more tower sites more quickly and thus has created a demand to expedite the process of building a tower site. Wind energy turbine towers are often located far from sources of concrete and may have limited accessibility as well as difficult terrain.

According to an example embodiment of the invention, a tower assembly includes a tower and a base assembly. The tower is generally conventional in structure and will not be described in detail here. The tower may be of a type used to support, for example, cell phone antennas, wind power equipment, lighting or weather monitoring equipment.

The base assembly generally includes a main pedestal support, bottom trays, side support panels, primary support beams and secondary support beams.

The main support pedestal is centrally located within the foundation and includes a vertical cylindrical or polygonal pipe structure having top and bottom plates secured thereto. The top and bottom plates are secured to the cylinder and extend out radially from the top and bottom of the cylinder or polygonal structure. The top plate presents multiple bolt holes typically uniformly spaced around the top plate and located outwardly from the circumference of the cylinder or polygonal tube. The main support pedestal also presents gussets radially disposed around an outer circumference thereof. The gussets are typically evenly spaced around the cylinder or polygonal tube and extend vertically from a top to a bottom of the tubular structure and are bounded by the top plate and the bottom plate.

The bottom trays are secured to the base of the main support pedestal and are arranged generally horizontally around the main support pedestal base. The bottom trays are formed of plates, typically having a polygonal geometry. According to an example embodiment of the invention, the bottom trays are generally trapezoidal in shape having a small end of the trapezoid located centrally and a large end located peripherally. The bottom trays are secured proximate an inner edge thereof to the main support pedestal and proximate an outer edge thereof to the side support panels.

According to an example embodiment of the invention, the side support panels are generally rectangular plate-like structures arranged vertically around an outer circumference of the foundation. The length of each rectangular side support panel is approximately equal to that of the side length of the long side of the bottom trays. The bottom trays are secured to the side support panels. Adjacent side support panels are secured together by a hinge-like connection and a hinge pin thus forming the outer perimeter of the base. The hinge-like connection generally includes mating hinge barrels on the edges of adjacent side support panels. Alternate hinge barrels are secured on each of the mating edges.

According to an example embodiment of the invention, the primary support beams form part of a truss-like support arm. Each primary support beam is secured to the gussets near the top of the main support pedestal. The primary support beams angle downward from near the top of the main support pedestal to the outside of the foundation to be secured with the side support panels and the bottom trays at a juncture thereof.

According to an example embodiment of the invention, a secondary support beam is secured at a first end to approximately the mid-point of the primary support beam and at a second end thereof to a top of a corresponding side support panel.

According to an example embodiment, the base assembly bottom support pallet is formed of the bottom trays. Generally, this forms a regular polygon for example, a regular hexagon assembled from an equal quantity of bottom support trays, side support panels, primary support beams and secondary support beams. In the case of hexagonal assembly, there is six of each of these structures. While the primary example discussed in this application is a hexagonal structure, it should be understood that the invention is not limited to hexagonal structures. The structures may for example be hexagonal, octagonal, decagonal, dodecagonal or tetradecagonal. That is structures according to the invention may have six, eight, ten twelve or fourteen sides or a larger number of sides depending upon the involvement. Embodiments having an odd number of sides are also contemplated.

According to an example embodiment of the invention, the main support pedestal, bottom trays and bottoms of side support panels are connected together by fasteners such as bolts. According to an example embodiment, the primary support beam extends outwardly along the bottom trays to the respective side support panels and is secured at both the connection between the bottom trays and the side support panels and at the gussets near the main support pedestal. This structural arrangement provides strength and rigidity of the connection between the main support pedestal and the bottom trays.

According to an example embodiment, the primary and secondary support beams may be formed, for example, from galvanized steel angle. The connection between the primary support beam and the foundation may be accomplished by fasteners such as bolts. The bottom trays and side support panels as well as a primary support beam may be secured by a single fastener.

The primary support beam may be secured to the gussets on the main support pedestal near the top flange also by a bolt or other fastener. The bottom side of each side support panel is secured to one of the vertical support bars of a bottom tray and to the other side support panels via a hinge-like connection. A pin is passed through hinge barrels of the hinge-like connection to hold each of the side support panels together with its adjacent side support panel. The pins are secured in place by an R-type stop pin at the bottom.

Once the base assembly is fully assembled it is filled with ballast. Examples of ballast that can be utilized include soil, gravel, bricks, concrete blocks and sand. Of course other ballast material may be used so long as the material is sufficiently dense to stabilize the base assembly. The use of local materials as ballast assists in reducing costs for installation.

Accordingly, a base assembly in accordance with the present invention may be utilized to replace a traditional concrete foundation used for installing self-supporting towers. The base assembly according to the present invention is easy to install, easy to handle and may be assembled and ready for use in a single day. This is a great advantage over concrete foundations which require significant curing times. The base assembly of the present invention may be used in multiple ways including in the ground, above the ground and may utilize many different types of ballast. The base assembly of the present invention can be disassembled and relocated and can be used for both short term and long term deployment.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
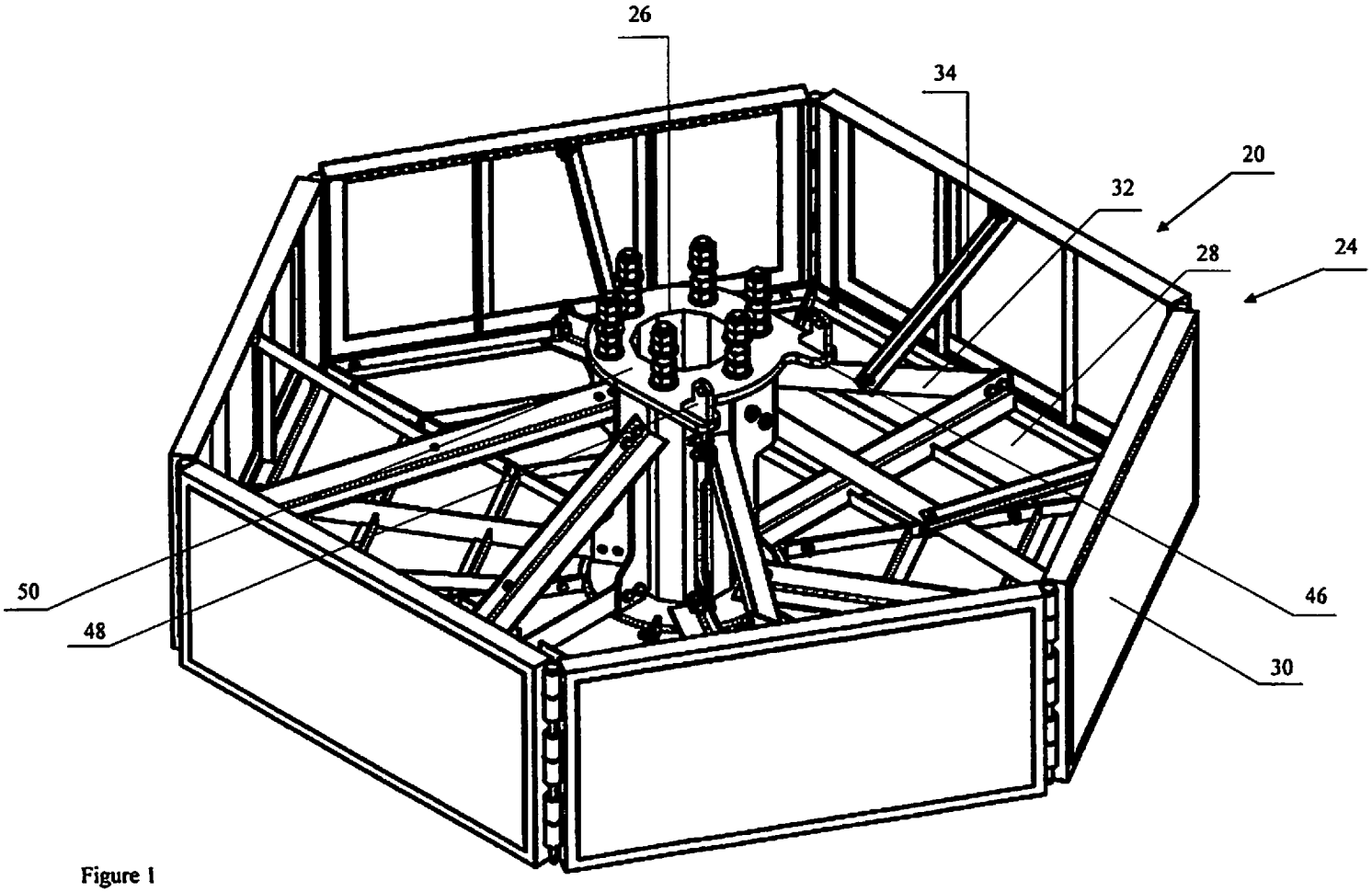
FIG. 1 is a perspective view of a base assembly according to an example embodiment of the invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Figure 5:
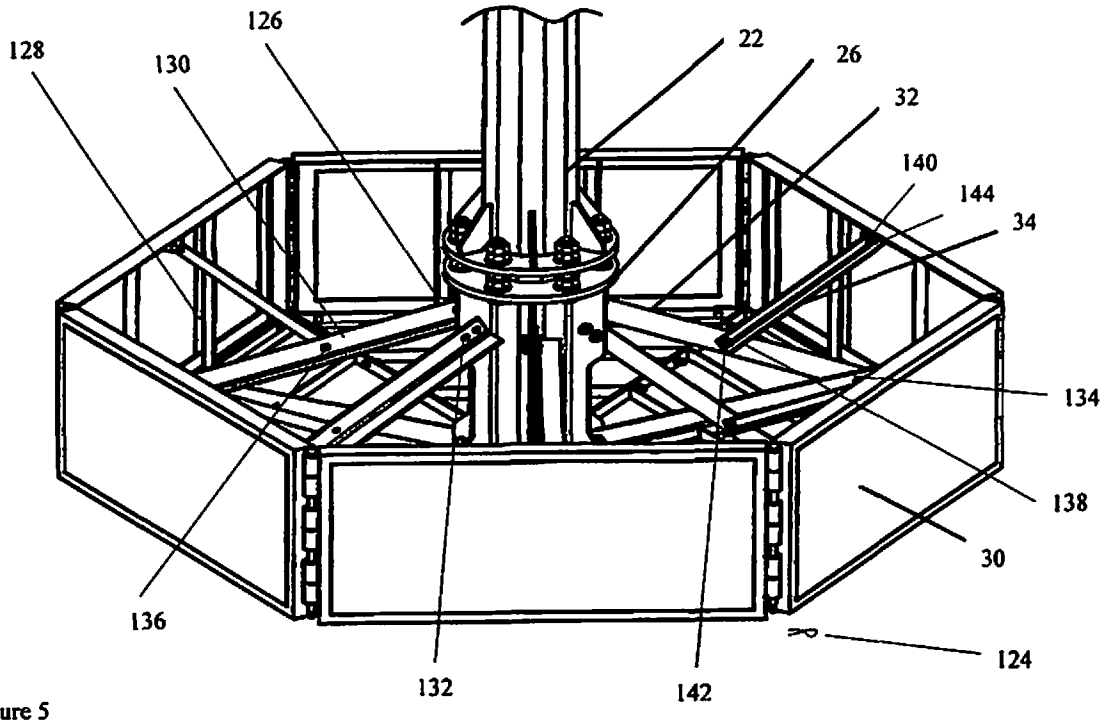
FIG. 5 is a perspective view of an assembled base assembly including a tower according to an example embodiment of the invention.
Figure 6:
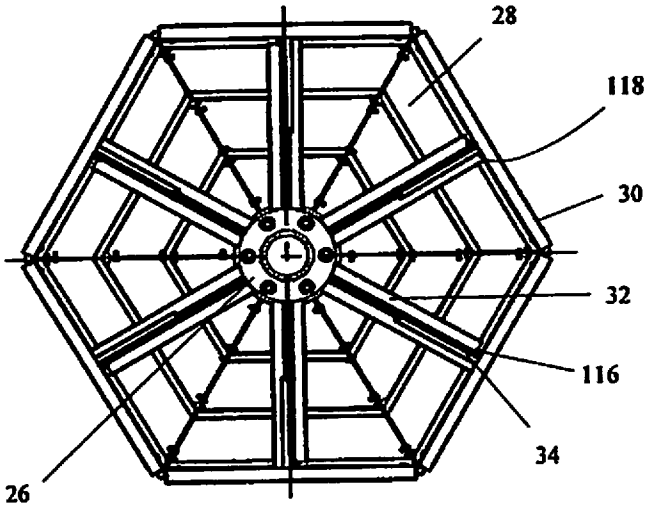
FIG. 6 is a plan view of a hexagonal tower base according to an example embodiment of the invention.
Figure 7:
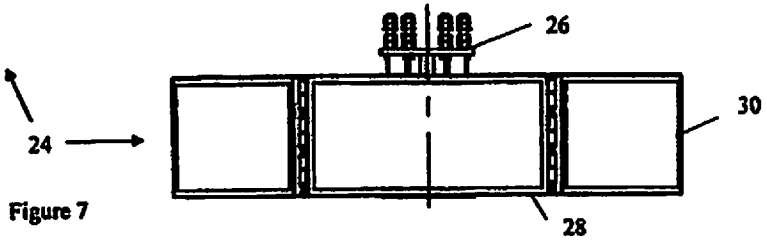
FIG. 7 is an elevational view of the base assembly of FIG. 6.
Figure 8:
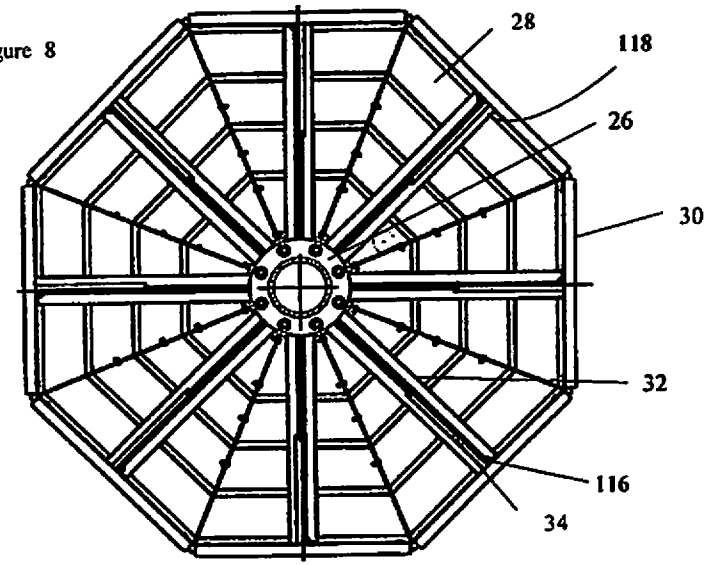
FIG. 8 is a plan view of an octagonal base assembly according to an example embodiment of the invention.
Figure 9:
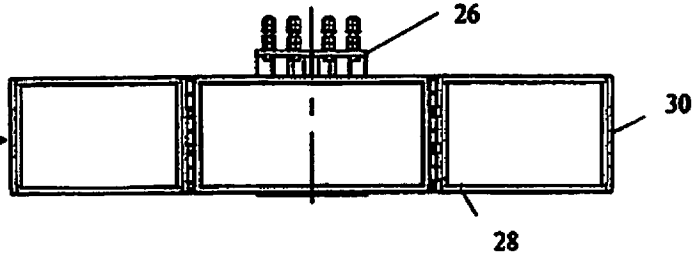
FIG. 9 is an elevational view of the base assembly of FIG. 8.
Figure 10:
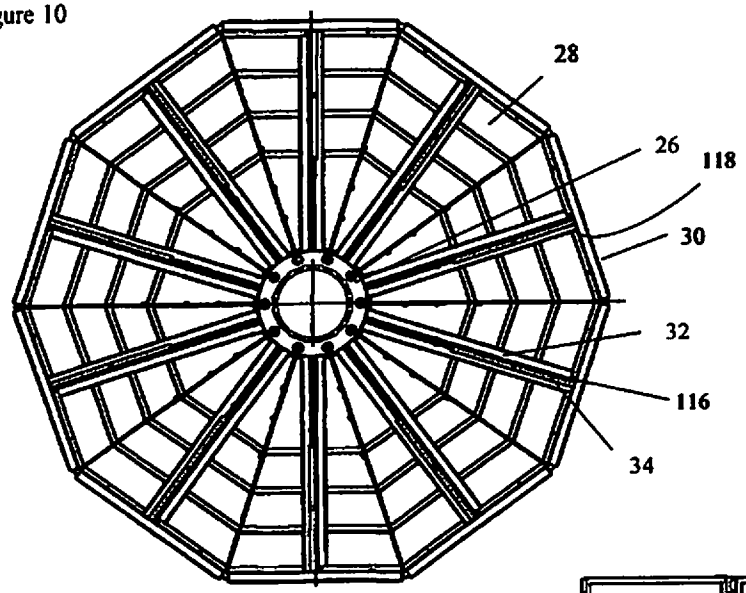
FIG. 10 is a plan view of a ten sided base assembly according to an example embodiment of the invention.
Figure 11:
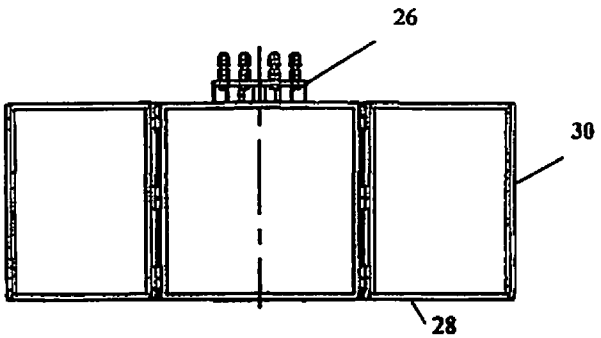
FIG. 11 is an elevation view of the base assembly of FIG. 10.
Figure 12:
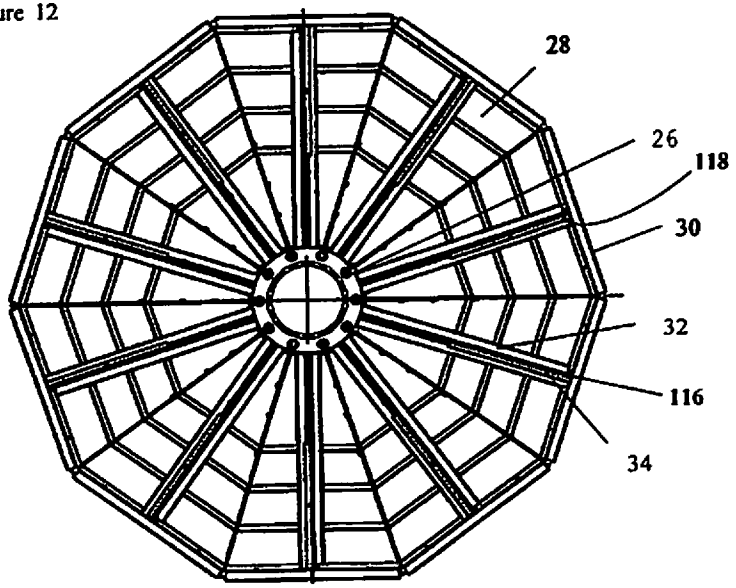
FIG. 12 is a plan view of a ten sided base assembly according to an example embodiment of the invention.
Figure 13:
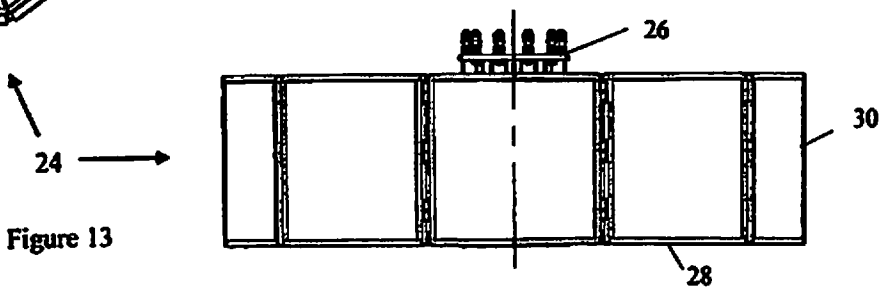
FIG. 13 is an elevational view of the base assembly of FIG. 12.
Figure 14:
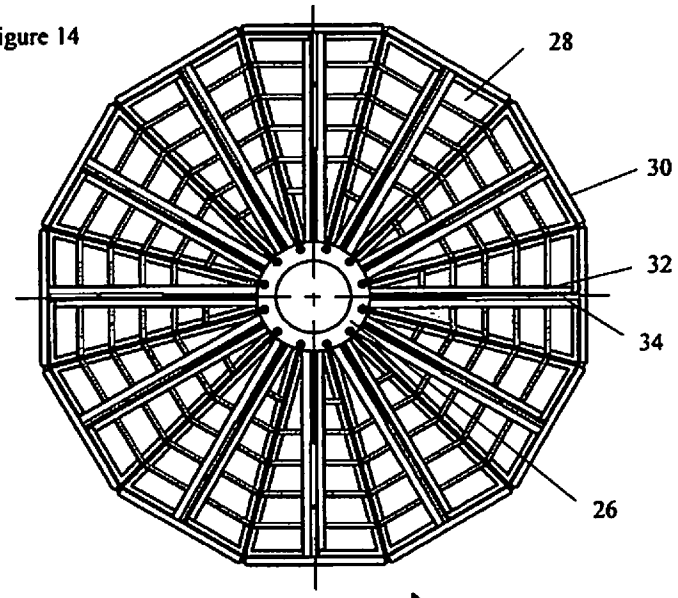
FIG. 14 is a plan view of a twelve sided base assembly according to an example embodiment of the invention.
Figure 15:
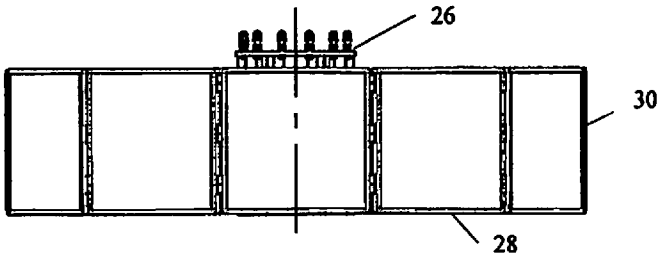
FIG. 15 is an elevational view of the base assembly of FIG. 14.
Figure 16:
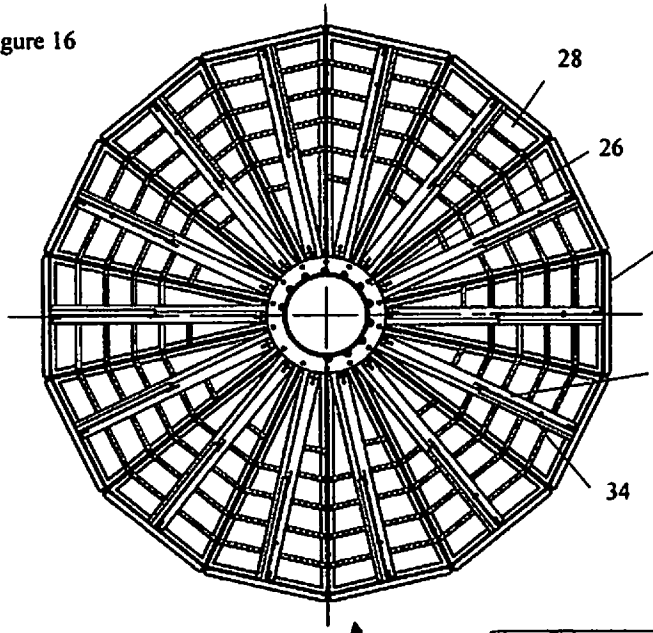
FIG. 16 is a plan view of a fourteen sided base assembly according to an example embodiment of the invention.
Figure 17:
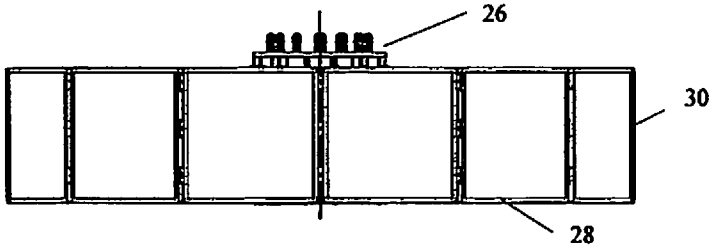
FIG. 17 is an elevational view of the base assembly of FIG. 16.

Referring to FIGS. 1 and 5, tower foundation 20 according to an example embodiment of the invention generally includes tower 22 and base assembly 24. Tower 22 is generally conventional in design and can include a monopole tower such as those used to support cell phone transmission antennas, lights or wind power equipment.

Base assembly 24 is a generally basket-like or topless container structure. Base assembly 24 generally includes main pedestal support 26, bottom trays 28, side support panels 30, primary support beams 32 and secondary support beams 34. Main pedestal support 26 is centrally located and is surrounded by bottom trays 28. In the depicted example embodiment, there are six bottom trays 28 and a generally hexagonal structure. However, this should not be considered limiting as various embodiments of the invention as depicted in FIGS. 6-16 may have other polygonal structures having anywhere between six to fourteen sides. Side support panels 30 are arranged around the perimeter of bottom trays 28 and are secured to one another and are also secured to primary support beams 32 and secondary support beams 34. Primary support beams 32 extend generally from main pedestal support 26 to side support panels 30. Secondary support beams 34 extend generally from primary support beams 32 to side support panels 30.

Figure 2:
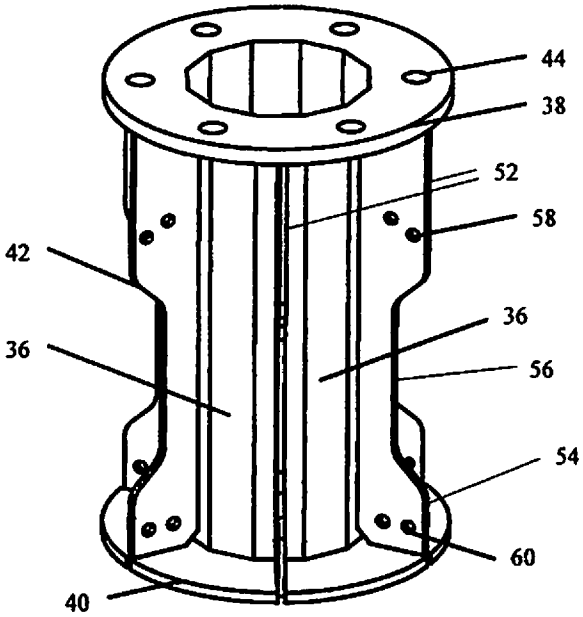
FIG. 2 is a perspective view of a main pedestal support according to an example embodiment of the invention.

Referring particularly to FIGS. 1 and 2, main pedestal support 26 generally includes tubular member 36, top flange 38, bottom flange 40 and a plurality of longitudinal gussets 42. The number of longitudinal gussets is equal to the number of bottom trays 28, the number of side support panels 30, the number of primary support beams 32 and the number of second support beams 34 according to the depicted example embodiment.

Tubular member 36 is conveniently formed of a steel tube having a cylindrical or polygonal cross-section. Tubular member 36 is conveniently formed of steel tube; however it may be formed of aluminum tube or another material of sufficient strength and rigidity. If tubular member 36 is polygonal in cross-section, it is convenient, according to an example embodiment, if the polygon has a number of sides equal to the number of longitudinal gussets 42 or multiple of the number of longitudinal gussets 42.

Figure 3:
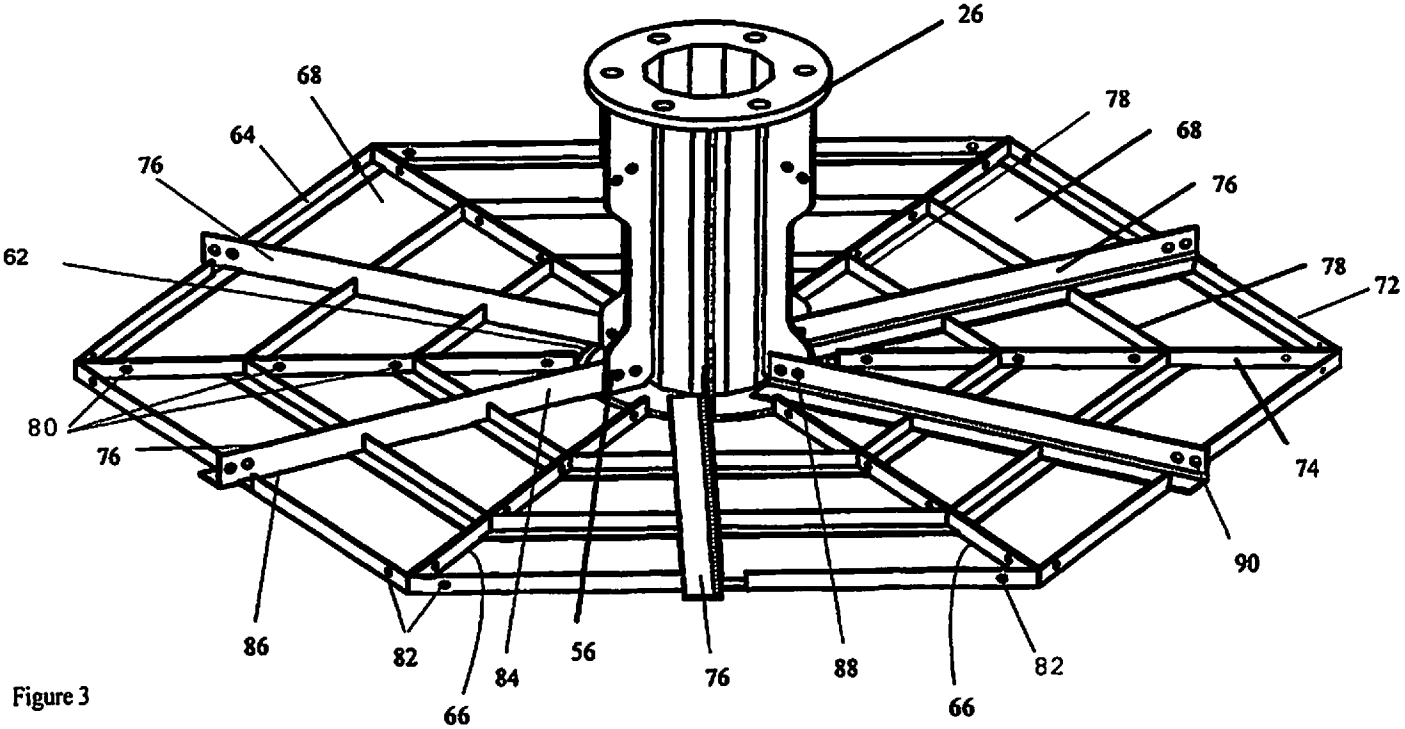
FIG. 3 is a perspective view of a main pedestal support surrounded by six bottom trays according to an example embodiment of the invention.

Referring again to FIGS. 1, 2 and 3, top flange 38 is secured to tubular member 36, for example, by welding. Tower top flange 38 presents tower fastener holes 44 located regularly therein about its perimeter. Tower fastener holes 44 are conveniently located midway between adjacent longitudinal gussets 42. This should not be considered limited however.

Referring to FIG. 1, according to another embodiment, top flange 38 may include tower hinge extensions 46 supporting tower hinge tabs 48. According to the depicted embodiment, tower hinge tabs 48 are pierced by hinge holes 50. Tower hinge tabs are spaced to accommodate tower tabs (not depicted) on tower 22.

Bottom flange 40 is located at an opposing end of tubular member 36 from top flange 38. Bottom flange 40 is generally perpendicular to tubular member 36 and extends radially outward therefrom.

Referring particularly to FIG. 2, longitudinal gussets 42 are evenly spaced about tubular member 36 and extend between top flange 38 and bottom flange 40 according to the depicted embodiment. Longitudinal gussets 42 may conveniently be formed of plate or sheet steel and present upper extension portion 52, lower extension portion 54 and middle portion 56. Upper extension portion 52 is joined to top flange 48 for example by welding. Lower extension portion 54 is joined to bottom flange 40 for example by welding. Upper extension portion 52, lower extension portion 54 and middle portion 56 abut tubular member 36 and may be joined thereto for example by welding. Upper extension portion 52 is pierced by primary support fastener holes 58. In the depicted embodiment, there are two primary support fastener holes 58. However, there may be as few as 1 or more than 2 primary support fastener holes 58.

Lower extension portion 54 is pierced by tray fastener holes 60. In the depicted embodiment, there are two tray fastener holes 60, however, this should not be considered limiting as there may be as few as one or more than two tray fastener holes 60.

Top flange 38 and bottom flange 40 may conveniently be formed of steel plate or sheet. Longitudinal gussets 42 may also be conveniently formed of steel plate or sheet though other materials may be utilized as well so long as they have sufficient rigidity and strength.

Referring particularly to FIGS. 2, 6, 8, 10, 12, 14 and 16, bottom trays 28 in the depicted embodiment are generally trapezoidal-shaped structures. Bottom trays 28 may be conveniently fabricated from sheet steel and steel angle, however, this should not be considered limiting as other materials may be utilized. Bottom trays 28, according to the depicted embodiment, present inner edge 62, outer edge 64 and side edges 66. Inner edge 62 and outer edge 64 are generally parallel and inner edge 62 is shorter than outer edge 64. Side edges 66 are angled relative to inner edge 62 and outer edge 64.

Bottom trays 28 generally include base sheet 68, optional inner edge angles (not shown), outer edge angles 72, side edge angles 74, central reinforcement beam 76 and perpendicular reinforcements 78. Inner edge angles, if present, are secured to inner edge 62 of base sheet 68 for example by welding. Outer edge angles 72 are secured to outer edge 64 of base sheet 68, for example, by welding. Side edge angles 74 are secured to side edges 66 of base sheet 68, for example, by welding. Side edge angles 74 present adjacent panel fastener holes 80. Side edge angles 74 are pierced by adjacent tray fastener holes 80. Outer edge angles 72 are pierced by side panel fastener holes 82.

Central reinforcement beam 76 extends generally radially through a center of base sheet 68 and extends from inner edge 62 to outer edge 64. Central reinforcement beam 76 extends slightly beyond inner edge 62 and outer edge 64. Central reinforcement beam 76 includes inner end 84 and outer end 86. Inner end 84 is pierced by gusset fastener holes 88. Outer end 86 is pierced by panel fastener holes 90. Perpendicular reinforcements 78 extend in both directions between central reinforcement beam 76 and side edge angles 74. Perpendicular reinforcements 78 are oriented generally parallel to inner edge angles, if present, and outer edge angles 72 in the depicted embodiment. Central reinforcement beams 76 and perpendicular reinforcements 78 are conveniently secured to base sheet 68 for example by welding.

Figure 4:
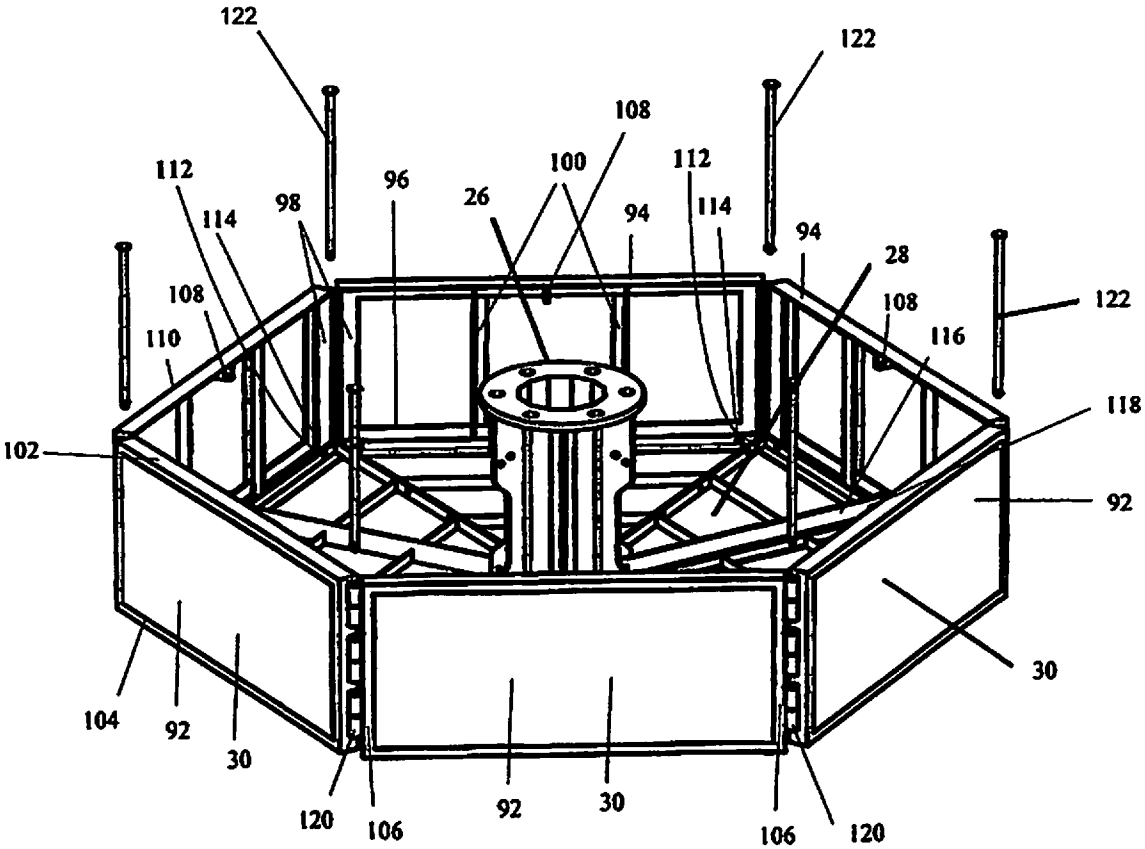
FIG. 4 is a partially exploded perspective view of a main pedestal support, bottom trays and side support panels according to an example embodiment of the invention.

Referring particularly to FIG. 4, side support panels 30 are generally rectangular in structure and include side panel plate 92, upper angle 94, lower angle 96, side angles 98 and vertical reinforcement 100. Upper angle 94 is secured to side panel plate 92 at upper edge 102. Lower angle 96 is secured to lower edge 104 of side panel plate 92. Side angles 98 are secured to side edges 106 of side panel plate 92. These structures may all be secured for example by welding.

Vertical reinforcements 100 extend generally vertically between upper angle 94 and lower angle 96.

Upper angle 94 further includes central secondary support tab 108 pierced by fastener hole 110.

Lower angle 96 also includes corner tabs 112 pierced by fastener hole 114 and central primary support tab 116 pierced by fastener hole 118.

Side edges 106 also include hinge barrels 120 secured to an outer portion thereof. Hinge barrels 120 are sized and structured to receive hinge barrels pins 122 therethrough. Hinge barrel pins 122 are structured to accept R clip 124 at an end thereof.

Referring particularly to FIG. 1, primary support beams 32 generally include inner end 126, outer end 128 and central portion 130. Inner end 126 is pierced by gusset fastener holes 132. Outer end 128 is pierced by lower panel fastener holes 134. Central portion 130 is pierced by central beam fastener holes 136.

Secondary support beams 34 generally include inner end 138 and outer end 140. Inner end 138 is pierced by primary support fastener holes 142. Outer end 140 is pierced by panel fastener holes 144.

Primary support beams 32 and secondary support beams 34 may be fabricated from steel angle or other sufficiently rigid material.

In operation, tower foundation 20 is placed on a prepared area. The prepared area is leveled prior to installation for example by placement of an aggregate and leveling the aggregate prior to installation.

Main pedestal support 26 is placed centrally on the leveled prepared area. Bottom trays 28 are positioned around main pedestal support 26 with inner end 84 of central reinforcement beam 76 located adjacent to lower extension portions 54 of longitudinal gussets 52.

Once bottom trays 28 are all located, fasteners such as bolts (not shown) may be utilized to secure inner end 84 of central reinforcement beam 76 to lower extension portions 54 of longitudinal gussets 42. Bottom trays 28 may be secured to each other by the application of fasteners through adjacent tray fastener holes 80. Side support panels 30 are secured to bottom trays 28 by application of fasteners through outer edge angles 72 through corner tabs 112. Side support panels 30 are secured to each other by aligning adjacent hinge barrels 120 and inserting hinge barrel pins 122 through hinge barrels 120. Hinge barrel pins 122 are then secured by the application of R clips 124 at a lower end thereof. When all side support panels 30 are in place, primary support beams 32 are installed.

Primary support beams 32 are installed by coupling inner end 126 to upper extension portion 52 of longitudinal gussets 42 and outer end 128 to central primary support tab 116 at the lower edge of side support panels 30. Secondary support beams 34 are secured at inner end 138 to central portion 130 of primary support beams 32. Outer ends 140 of secondary support beams 34 are secured to central secondary support tab 108 of side support panels 30. All fasteners are then secured tightened.

The interior of base assembly 24 is then filled with ballast such as soil, gravel, bricks, concrete blocks or other locally available ballast.

Tower 22 is then secured to main pedestal support 26 via top flange 38. Tower 22 is typically secured to top flange 38 via bolts.

In the embodiment where tower hinge tabs 48 are present, tower hinge tabs 48 are secured to a base of tower 22 via similar tabs (not shown) on tower 22. Tower 22 may then rotated from a horizontal position to a vertical position and secured by fasteners.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A tower support structure, comprising:

a central vertically oriented main pedestal support structured to engage to a base of the tower;

a plurality of surrounding horizontally oriented base members, each of the horizontally oriented base members further comprising a base sheet and a central reinforcement beam, the central reinforcement beam extending across and over a top of a base sheet of the bottom tray and being structured to couple to one of a plurality of longitudinal gussets extending along the sides of the main pedestal support at an inner end of the central reinforcement beam and being structured at an outer end of the central reinforcement beam to couple to one of a plurality of side support panels proximate a horizontal center of a bottom edge of the side support panel;

a plurality of primary support beams, each of the primary support beams including an inner end structured to be coupled to one of the plurality of longitudinal gussets proximate an upper end of the one of the longitudinal gussets and an outer side support panels proximate a horizontal center of the bottom edge of the side support panel.

2. The tower support structure as claimed in claim 1, wherein each of the side support panels comprises hinge barrels along sides thereof, the hinge barrels being configured to rotatably engage to hinge barrels of an adjacent side panel and to receive a hinge pin therein whereby each side support panel is coupled to an adjacent side support panel.

3. The tower support structure as claimed in claim 1, wherein the bottom trays and the side support panels together form a basket structure which is finable with ballast.

4. A method of preparing a foundation for a tower structure, the method comprising:

placing a main pedestal support on a generally level surface, the main pedestal support comprising a tower coupling member that is coupleable to the tower structure;

locating a plurality of bottom trays surrounding a base of the main pedestal support, each of the plurality of bottom trays including a central reinforcement beam extending across and over a top of a base sheet of the bottom tray, and securing each of the central reinforcement beams of the plurality of bottom trays to one of a plurality of longitudinal gussets extending along sides of the main pedestal support;

locating a plurality side support panels at a perimeter of the bottom support trays, and coupling each of the central reinforcement beams of the plurality of side support panels to one of the side support panels;

coupling an inner end of each of a plurality of primary support beams proximate an upper end of one of the longitudinal gussets; and coupling an outer end of each of the plurality of primary support beams proximate an outer end of the central reinforcement beam and to one of the side support panels proximate a horizontal center of the bottom edge of the side support panel.

5. The method as claimed in claim 4, further comprising coupling a plurality of secondary support beams to the plurality of primary support beams at a at a first end of the secondary support beams and coupling a second end of the secondary support beams to the plurality of side support panels.

6. A method of making a tower support structure, the method comprising:

fabricating a main pedestal support;

fabricating a plurality of bottom trays structured to surround the main pedestal support by securing a central reinforcement beam to a base sheet such that the central reinforcement beam extends across and over a top of a base sheet of the bottom tray;

fabricating a plurality of side support panels structured to surround the plurality of bottom trays;

fabricating a plurality of primary support beams structured to couple the main pedestal support to each of the plurality of bottom trays and each of the plurality of side support panels; and fabricating a plurality of secondary support beams structured to couple each of the plurality of primary support beams to a respective one of the plurality of side support panels.

7. The method as claimed in claim 6, wherein fabricating in the main pedestal support further comprises securing a top flange and a bottom flange to a tubular support member and securing a plurality of gussets to sides of the tubular member extending between the top flange and the bottom flange.

8. The method as claimed in claim 7, further comprising securing the top flange, the bottom flange and the plurality of gussets to the tubular member by welding.

9. A method of making a tower support structure, the method comprising:

fabricating a main pedestal support;

fabricating a plurality of bottom trays structured to surround the main pedestal support;

fabricating a plurality of side support panels structured to surround the plurality of bottom trays;

fabricating a plurality of primary support beams structured to couple the main pedestal support to each of the plurality of bottom trays and each of the plurality of side support panels; and fabricating a plurality of secondary support beams structured to couple each of the plurality of primary support beams to a respective one of the plurality of side support panels;

wherein fabricating the plurality of bottom trays further comprises securing a central reinforcement beam to a base sheet extending over a top of the base sheet from a short side of a base sheet to a longer side of the base sheet and making the central reinforcement beam of a length such that the central reinforcement beam extends beyond the shortest side and the longest side of the base sheet when the central reinforcement beam is secured to the base sheet.

10. The method as claimed in claim 9, further comprising securing the central reinforcement beam to the base sheet by welding.

11. The method as claimed in claim 9, further comprising securing outer edge angles and side edge angles to the base sheet.

12. The method as claimed in claim 6, wherein fabricating the side support panels further comprises securing an upper angle, a lower angle, and two side angles of a side panel plate.

13. The method as claimed in claim 12, further comprising securing hinge barrels to two sides of the side support panels.

14. The method as claimed in claim 12, further comprising securing vertical reinforcements to the side panel plate.

15. The method as claimed in claim 12, further comprising securing a central primary support tab and a central secondary support tab to the lower angle and upper angle, respectively.

16. The method as claimed in claim 12, further comprising securing corner tabs at the corners of the side support panel.

17. The method as claimed in claim 6, wherein fabricating the primary support beams further comprises cutting a first elongate member to length and forming therein gusset fastener holes proximate a first end thereof and lower panel fastener holes proximate a second end thereof as well as secondary support fastener holes proximate a center thereof.

18. The method as claimed in claim 6, wherein fabricating the secondary support beams further comprises cutting a second elongation member to length and forming fastener holes proximate each end thereof.

* * * * *